US005377488A

United States Patent [19]

Malina

[11] Patent Number: 5,377,488

[45] Date of Patent: Jan. 3, 1995

[54] HYDRO-PNEUMATIC PRESSURE TRANSFORMER

[75] Inventor: Viktor Malina, Kisslegg, Germany

[73] Assignee: Tox-Pressotechnik GmbH, Weingarten, Germany

[21] Appl. No.: 84,975

[22] Filed: Jul. 2, 1993

[30] Foreign Application Priority Data

Jul. 2, 1992 [DE] Germany ..... 4223411

[51] Int. Cl.[6] ..... F15B 7/00

[52] U.S. Cl. ..... 60/560; 60/563; 60/484; 92/80; 92/86

[58] Field of Search ..... 60/560, 563, 565, 584, 60/593; 92/80, 82, 86

[56] References Cited

U.S. PATENT DOCUMENTS 3,426,530 2/1969 Georgelin ..... 60/560
4,300,351 11/1981 Grullmeier ..... 60/560
5,040,369 8/1991 Rapp ..... 60/584
5,265,423 11/1993 Glaser ..... 60/560

FOREIGN PATENT DOCUMENTS 2304752 8/1974 Germany ..... 60/560

*Primary Examiner*—Thomas E. Denion
*Attorney, Agent, or Firm*—Edwin E. Greigg; Ronald E. Greigg

[57] ABSTRACT

A hydro-pneumatic pressure transformer with a storage piston fixed between storage oil and compressed air, which furthermore is centrally penetrated by a plunger piston, wherein, for the separation of oil from water, relief grooves are provided on the jacket face as well as in the wall of the central bore, which are connected with each other and are pressure-relieved via a ventilating bore leading to the exterior.

21 Claims, 2 Drawing Sheets

HYDRO-PNEUMATIC PRESSURE TRANSFORMER

FIELD OF THE INVENTION

The invention relates to a hydro-pneumatic pressure transformer as set forth hereinafter.

BACKGROUND OF THE INVENTION

A main problem with the prior art hydro-pneumatic pressure transformers resides in the sealing between the storage chamber and the control chamber, because the hydraulic pressures in the storage chamber and the pneumatic pressures in the control chamber continuously change in the course of a work cycle, and this is not necessarily synchronously. Thus, there is the danger, on the one hand, that oil from the storage chamber reaches the control chamber and leakage losses are created by this, which could impair the work capacity of the hydro-pneumatic pressure transformer. On the other hand there is the danger of air from the control chamber reaching the storage chamber, where it is absorbed by the oil with the disadvantage that it reaches the work chamber and tends there to create increased compressibility in the high-pressure phase of the pressure stroke, along with all the disadvantages for the work capability resulting therefrom.

For this reason, in a known hydro-pneumatic pressure transformer of the species (German Published, Non-Examined Patent Application DE-OS 28 10 894), two radial seals are provided toward the wall of the work cylinder as well as the jacket face of the plunger piston, which have the purpose of achieving an optimal separation of the air from the oil. In this case it is particularly problematic that the tendency of the air to move from the control chamber to the storage chamber is not at all evident in the low pressure phase, but in the high pressure phase, in the course of which small amounts of air are also "pumped so that they bypass" the radial seals in the form of wall laminates during the axial movement of the storage piston.

OBJECT AND SUMMARY OF THE INVENTION

In contrast to this, the hydro-pneumatic pressure transformer has the advantage that the lowest possible pressure is obtained in the annular ventilating grooves, for example ambient pressure, so that any amounts of air passing the radial seal provided in the direction towards the control chamber can be deflected.

If amounts of oil from the storage chamber should reach the annular ventilating grooves, it is not disadvantageous for the respective work process. If there is considerable oil loss, it is only necessary to refill the storage chamber with oil.

In accordance with a further advantageous embodiment of the invention, a bore in the work cylinder is used for ventilation, which always overlaps the annular jacket groove independently of the working stroke. Complete relief is assured in the initial position as well as in the end position—possibly with only small remaining amounts in the storage chamber—and in this case the ventilation bore can lead directly to tile atmosphere.

In accordance with a further advantageous embodiment of the invention, the annular relief groove in the bore wail is connected with a groove on the jacket face by at least one radial bore of the storage piston. Such a radial bore can be provided in a simple manner in the form of a cross bore, wherein the respective beginning and end of this radial bore terminate in the jacket faces of the annular groove and therefore have no frictional contact with the working cylinder or the plunger piston.

In accordance with a further advantageous embodiment of the invention, additional annular sealing grooves, known per se, for receiving radial seals are provided on both sides of the annular ventilating grooves.

Further advantages and advantageous embodiments of the invention ensue from the following description, the drawings and the claims.

An exemplary embodiment of the subject of the invention is shown in the drawings and will be described in detail below.

DETAILED DESCRIPTION OF THE PREFERRED EMBODIMENT

Figure 1:
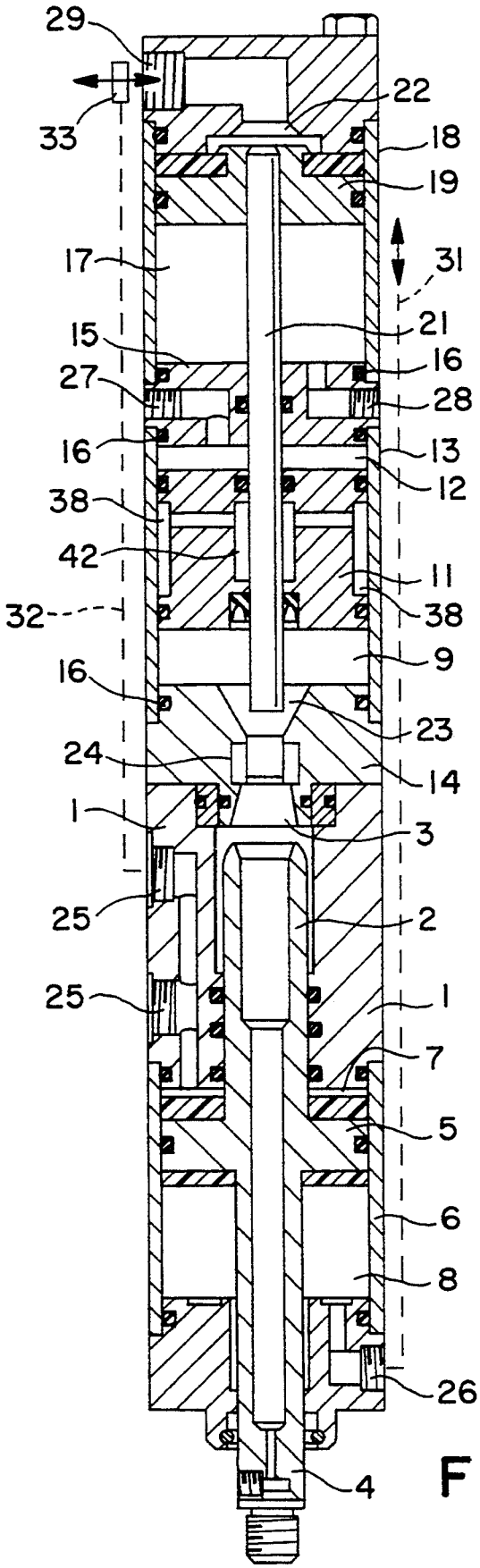
FIG. 1 is a longitudinal sectional view of a hydro-pneumatic pressure transformer.
Figure 2:
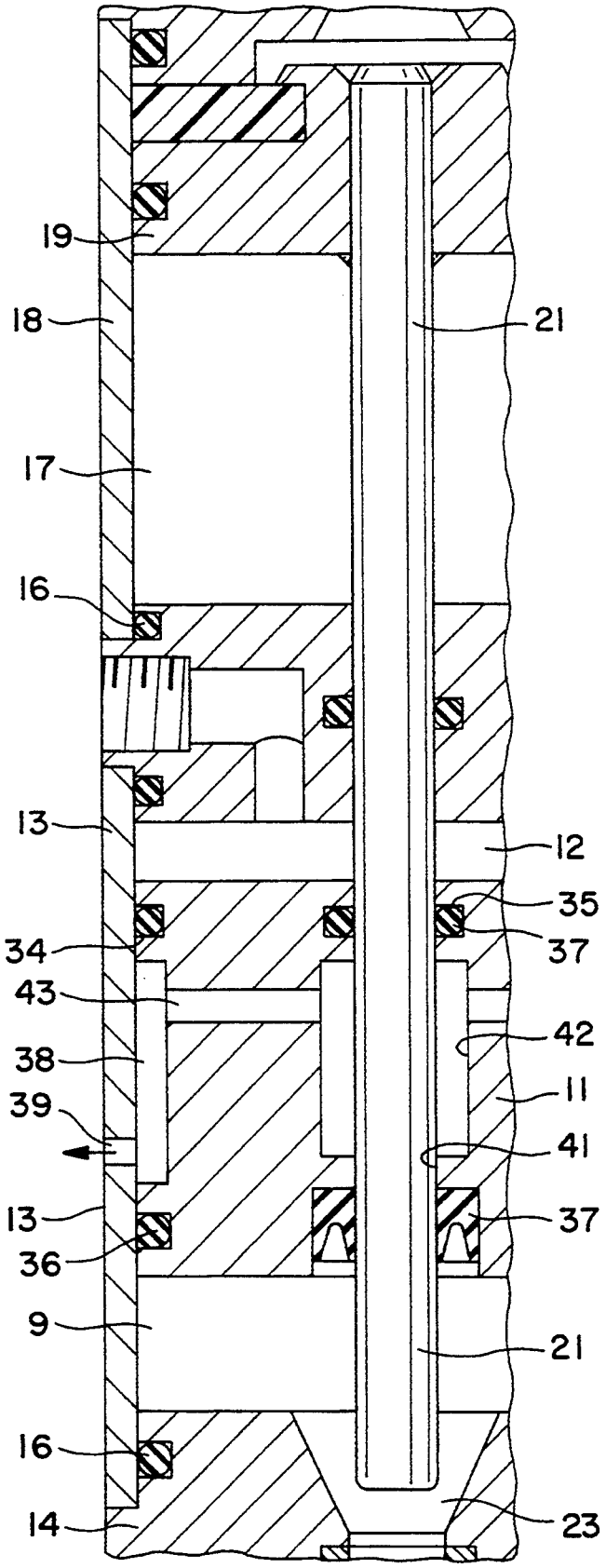
FIG. 2 is a detail from FIG. 1 in an enlarged scale.

In the hydro-pneumatic pressure transformer illustrated in FIGS. 1 and 2, a working piston 2 is disposed axially displaceable and sealed radially in a housing 1 and, together with the housing, delimits a work chamber 3 filled with hydraulic oil. A piston rod 4 extending outside of the housing is disposed on the working piston 2. In addition, the working piston 2 has an auxiliary piston 5 as a collar, which is radially sealed towards a casing 6 and in this way separates two pneumatic chambers 7 and 8 from one another, which are alternatingly supplied with pneumatic pressure for the rapid movement of the working piston 2. As soon as there is sufficient working pressure in the pneumatic chamber 7, the working piston 2 is pushed down and, in the opposite way, with an appropriate high pressure in the pneumatic chamber 8 and reduced pressure in the pneumatic chamber 7, the working piston 2 is pushed back into the initial position illustrated.

A storage chamber 9 for hydraulic oil is located above the work chamber 3 and is hydraulically connected with it. Its storage chamber pressure is generated by a storage piston 11 and the pneumatic pressure in a control chamber 12. The pneumatic piston 11 is guided radially sealing and axially displaceable, in the manner of a free piston, in a casing 13 delimiting the storage chamber 9 as well as the control chamber 12. On the one end the casing 13 is closed off by a housing part 14 of the housing 1, and on the other by a separating wall 15. Appropriate faces for sliding on the casing 13 and having additional static seals 16 are provided on the housing part 14 and the separating wall 15. On the side facing away from the control chamber 12, the separating wall 15 is used to delimit a pneumatic chamber 17 surrounded by a casing 18 and in which the drive piston 19 of a plunger piston 21 is seated, which is displaceable counter to the hydraulic pressure in the work chamber 3.

The plunger piston 21 penetrates, is radially sealed and the separating wall 15 and the storage piston 11 and dips with its free end into the storage chamber 9. The drive piston 19 together with the plunger piston 21 are driven by compressed air which is fed into a drive chamber 22 above the drive piston 21, and the high pressure work cycle is initiated by this high pressure. In the course of this, after traveling a defined stroke, the plunger piston 21 dips into a connection bore 23 leading from the storage chamber 9 to the work chamber 3, by means of which this connection is closed with the cooperation of a radial seal 24. With the continued stroke of the plunger piston 21 and correspondingly deeper penetration into the work chamber 3, hydraulic fluid is displaced there, so that because of the relatively narrow diameter of the plunger piston a high working pressure is generated in the work chamber 3. This pressure corresponds to the ratio of the work surfaces of the drive piston 19 in relation to the plunger piston 21, based on the pneumatic pressure acting on the drive piston 19. The high hydraulic pressure generated in the course of this acts directly on the working piston 2 and causes the desired great force at the piston rod 4.

The pneumatic pressure in the drive chamber 22 is released for the return stroke of the plunger piston 21 and a corresponding pneumatic pressure is built up in the pneumatic chamber 17, so that the drive piston 19 with the plunger piston 21 is pushed back into the illustrated initial position. Following this, hydraulic fluid displaced by the working piston 2 from the work chamber 3 flows into the storage chamber 9, in the course of which the working piston 2, driven by the auxiliary piston 5 and by compressed air, is displaced into the pneumatic chamber 8 into the initial position, also illustrated.

The various pneumatic chambers are equipped with connecting conduits leading to the outside of the hydro-pneumatic pressure transformer, namely the pneumatic chamber 7 with the conduit 25, the pneumatic chamber 8 with the conduit 26, the control chamber 12 with the conduit 27, the pneumatic chamber 17 with the conduit 28 and the drive chamber 22 with the conduit 29. In accordance with an exemplary type of control, the connecting conduits 26 and 28 for the pneumatic chambers 8 and 17 are connected with each other via a pneumatic control line 31 so that when the pneumatic control pressure is supplied via these chambers, the auxiliary piston 5 and the drive piston 19 are pushed into the initial position shown. However, for the work stroke the pressure is released in the pneumatic control line 31 and guided into a pneumatic control line 32 connecting the connecting conduits 25, 27 and 29 with each other and wherein a valve 33, controlled as a function of pressure, is attached upstream of the connecting conduit 29. In this way the pneumatic pressure supplied is first supplied to the connecting conduits 25 and 27 and thus to the pneumatic chamber 7 and the control chamber 12, after which the auxiliary piston 5 with the work piston 2 is pushed downward with rapid movement and the storage piston 11 is pushed in accordance with the amount of hydraulic fluid flowing from the storage chamber 9 into the work chamber 3. The hydraulic volume in the work chamber 3 and the storage chamber 9 is constant as a whole, except for amounts of leakage which must be replenished now and then. As soon as the piston rod 4 encounters resistance (end of the rapid movement), the pressure in the pneumatic control line 32 increases and the valve 32, controlled as a function of pressure, releases the flow to the connecting conduit 29 and thus to the drive chamber 22, so that the drive piston 19 with the plunger piston 21 is pushed downward, having the above described effect.

The storage piston 11 is disposed between the storage chamber 9, filled with oil, and the control chamber 12, filled with air at different pressures in accordance with the above cited control, in the course of which it is mainly intended to prevent that oil from the storage chamber 9 reaches the control chamber 12 and, in the opposite way, air reaches the storage chamber 9. In accordance with the invention an absolute separation of air and oil at the storage piston 11 is used for this, in that it has annular grooves 34 and 35 with radial seals 36 and 37 in the direction toward the casing 13 as well as toward the plunger piston 21. The radial seals 37 toward the plunger piston 21 are shown one time embodied as a toroidal sealing ring and another as a packing. In order to obtain an absolute pressure release and thus the separation of air and oil in the area between the radial seals, an annular groove 38 is disposed on the jacket face of the storage piston 11, which is ventilated toward the outside of the unit via a ventilating bore 39 disposed in the casing 13. The ventilating bore 39 is disposed in relation to the annular groove 38 or the maximum stroke of the storage piston 11 in such a way that it always overlaps the annular groove 38. Furthermore, an annular groove 42 is provided in the central bore 41 of the storage piston 11, which is penetrated by the plunger piston 21, which is connected by means of a penetrating radial bore 43 with the constantly vented annular groove 38 on the jacket face of the storage piston 11.

All characteristics shown in the specification, the following claims and in the drawings can be essential for the invention by themselves as well as in arbitrary combinations.

What is claimed is:

1. A hydro-pneumatic pressure transformer, comprising, a unit housing, a work chamber (3), disposed in said unit housing, for fluctuating pressures, namely a low storage pressure and a high work pressure, a working piston (2), delimits the work chamber (3) at a front end and is actuatable by a work pressure in the unit housing (1) for its work stroke, which piston extends to an exterior by means of a piston rod (4), a storage chamber (9) is hydraulically connected with the work chamber (3) and is disposed in a casing (13), from which hydraulic oil under storage pressure flows into the work chamber (3) during a rapid movement of a work stroke and flows back again during a return stroke, a plunger piston (21) is hydraulically actuatable to provide a high pressure generator, which dips into the work chamber (3) after a rapid movement of the working piston (2), a storage piston (11) which delimits the storage chamber (9), is displaceable in the casing (13) and is penetrated by the plunger piston (21) and is radially sealed against the plunger piston (21) as well as the casing (13), a control chamber (12) on one side of the storage piston (11) faces away from the storage chamber (9), which is charged with air at different pressures, and a separating wall (15), delimits the control chamber (12) and is fixedly connected with the casing (13) and penetrated by the plunger piston (21), said separating wall is provided with radially outward leading connecting conduits (27, 28) for compressed air control, a pressure-relieving outer annular groove (38) in storage piston (11) is provided in the stroke direction between the radial seals (36, 34) for the absolute separation of oil from water, and an inner annular groove (42) is provided, between the radial seals (37), in the wall of the inner bore (41) penetrated by the plunger piston (21).

2. A hydro-pneumatic pressure transformer in accordance with claim 1, in which for a pressure relief of the outer annular groove (38), a ventilating bore (39) is provided in the casing (13), which always overlaps the outer annular groove (38).

3. A hydro-pneumatic pressure transformer in accordance with claim 2, in which the ventilating bore (39) leads to the atmosphere.

4. A hydro-pneumatic pressure transformer in accordance with claim 1, in which the outer annular groove (38) is connected with the inner annular groove (42) by a radial bore (43) in the storage piston (11).

5. A hydro-pneumatic pressure transformer in accordance with claim 2, in which the outer annular groove (38) is connected with the inner annular groove (42) by a radial bore (43) in the storage piston (11).

6. A hydro-pneumatic pressure transformer in accordance with claim 3, in which the outer annular groove (38) is connected with the inner annular groove (42) by a radial bore (43) in the storage piston (11).

7. A hydro-pneumatic pressure transformer in accordance with claim 1, in which separate annular sealing grooves (34, 35) for receiving radial seals (36, 37) are provided on both sides of the outer annular groove (38) or the inner annular groove (42).

8. A hydro-pneumatic pressure transformer in accordance with claim 2, in which separate annular sealing grooves (34, 35) for receiving radial seals (36, 37) are provided on both sides of the outer annular groove (38) or the inner annular groove (42).

9. A hydro-pneumatic pressure transformer in accordance with claim 3, in which separate annular sealing grooves (34, 35) for receiving radial seals (36, 37) are provided on both sides of the outer annular groove (38) or the inner annular groove (42).

10. A hydro-pneumatic pressure transformer in accordance with claim 4, in which separate annular sealing grooves (34, 35) for receiving radial seals (36, 37) are provided on both sides of the outer annular groove (38) or the inner annular groove (42).

11. A hydro-pneumatic pressure transformer in accordance with claim 1, in which a chamber (17) provided on the side of the separating wall (15) facing away from the control chamber (12) is controlled by air pressure for the restoration of a drive piston (19) connected with the plunger piston (21).

12. A hydro-pneumatic pressure transformer in accordance with claim 2, in which a chamber (17) provided on the side of the separating wall (15) facing away from the control chamber (12) is controlled by air pressure for the restoration of a drive piston (19) connected with the plunger piston (21).

13. A hydro-pneumatic pressure transformer in accordance with claim 3, in which a chamber (17) provided on the side of the separating wall (15) facing away from the control chamber (12) is controlled by air pressure for the restoration of a drive piston (19) connected with the plunger piston (21).

14. A hydro-pneumatic pressure transformer in accordance with claim 4, in which a chamber (17) provided on the side of the separating wall (15) facing away from the control chamber (12) is controlled by air pressure for the restoration of a drive piston (19) connected with the plunger piston (21).

15. A hydro-pneumatic pressure transformer in accordance with claim 7, in which a chamber (17) provided on the side of the separating wall (15) facing away from the control chamber (12) is controlled by air pressure for the restoration of a drive piston (19) connected with the plunger piston (21).

16. A hydro-pneumatic pressure transformer in accordance with claim 1, in which an auxiliary piston (5) is connected with the working piston (2), which can be pneumatically charged on both ends for rapid movement.

17. A hydro-pneumatic pressure transformer in accordance with claim 2, in which an auxiliary piston (5) is connected with the working piston (2), which can be pneumatically charged on both ends for rapid movement.

18. A hydro-pneumatic pressure transformer in accordance with claim 3, in which an auxiliary piston (5) is connected with the working piston (2), which can be pneumatically charged on both ends for rapid movement.

19. A hydro-pneumatic pressure transformer in accordance with claim 4, in which an auxiliary piston (5) is connected with the working piston (2), which can be pneumatically charged on both ends for rapid movement.

20. A hydro-pneumatic pressure transformer in accordance with claim 7, in which an auxiliary piston (5) is connected with the working piston (2), which can be pneumatically charged on both ends for rapid movement.

21. A hydro-pneumatic pressure transformer in accordance with claim 11, in which an auxiliary piston (5) is connected with the working piston (2), which can be pneumatically charged on both ends for rapid movement.

* * * * *